US005237754A

United States Patent [19]

Oexler

[11] Patent Number: 5,237,754

[45] Date of Patent: Aug. 24, 1993

[54] FIBER BUNDLE THICKNESS MEASURING DEVICE

[75] Inventor: Rudolf Oexler, Ingolstadt, Fed. Rep. of Germany

[73] Assignee: Schubert & Salzer, Ingolstadt, Fed. Rep. of Germany

[21] Appl. No.: 776,322

[22] PCT Filed: Apr. 5, 1991

[86] PCT No.: PCT/DE91/00293

§ 371 Date: Dec. 16, 1991

§ 102(e) Date: Dec. 16, 1991

[87] PCT Pub. No.: WO91/16595

PCT Pub. Date: Oct. 31, 1991

[30] Foreign Application Priority Data

Apr. 19, 1990 [DE] Fed. Rep. of Germany ..... 4012551

[51] Int. Cl.[5] ..... G01B 5/02; G01B 5/06

[52] U.S. Cl. ..... 33/501.02; 33/DIG. 11; 19/23

[58] Field of Search ..... 33/501.02, 501.03, 501.04, 33/DIG. 11, 783, 784, 734, 746, 747-749, 702; 19/0.23

[56] References Cited

U.S. PATENT DOCUMENTS 2,913,828 11/1959 Bloxham ..... 33/501.02
3,494,041 2/1970 Freeman ..... 33/702
4,136,454 1/1979 Jenkins et al. ..... 33/501.03
4,189,841 2/1980 Loepfe ..... 33/501.03
4,232,447 11/1980 Grunder et al. ..... 33/501.02
4,646,387 3/1987 Oswald et al. ..... 19/0.23

FOREIGN PATENT DOCUMENTS 873659 3/1942 France ..... 33/DIG. 11

OTHER PUBLICATIONS

"Ceramic Gages and Fixtures", American Machinist-/Metalworking Manufacturing, Jan. 21, 1963 p. 98.

*Primary Examiner*—Thomas B. Will
*Attorney, Agent, or Firm*—Dority & Manning

[57] ABSTRACT

A measuring device for measuring the thickness of fiber bundles such as slivers or the like on high output speed drawing frames within a predetermined tolerance range. The fiber bundle thickness is measured by a pair of rollers, one of which is supported for rotation about a fixed axis and the other of which is supported for rotation about a movable axis which permits it to move towards and away from the roller on the fixed axis. At least one of the rollers is composed of a material having a low coefficient of heat expansion under the temperatures generated when the bundle of fibers passes between the pair of rollers at high production output speeds. This avoids distortions in the measurement of the thickness of the fiber bundle.

6 Claims, 2 Drawing Sheets

FIBER BUNDLE THICKNESS MEASURING DEVICE

BACKGROUND OF THE INVENTION

The instant invention relates to a device for measuring the thickness of fiber slivers on drawing frames having a high production output without sacrificing quality.

Autoleveller drawing frames where a fiber sliver is scanned mechanically in order to ascertain fiber sliver thickness, and where the values found are converted into electrical signals are known. Such scanning devices are located before the actual drawing frame. They are used to scan the thickness of the arriving fiber sliver. Scanning is effected by means of scanning rollers. One of the two rollers is movably mounted and is moved out to a greater or lesser degree by the thickness fluctuations of the slivers. The measured voltage is transmitted to an electronic memory. The latter ensures that the drawing changes occur precisely at the instant when the deviating sliver segment is in the main drawing field. The change in draft is effected through a change in the rotational speed of the rollers of the draw frame. Such a known device is described in German Patent Publication DE-OS 25 44 029.

In addition to the scanning of the fiber sliver to be drawn, a method is known by which the drawn fiber sliver is scanned once more for control purposes. This is done by means of a pair of output roller installed at the input of the draw frame, independently of the scanning rollers. The drawn fiber sliver is scanned again, mechanically and a comparison between the desired and the actual value is made electronically from this mechanical scan. If an adjustable limit deviation is exceeded, the entire machine is stopped. This additional control, which is absolutely independent of the actual regulating system, is known under the name "sliver monitor". The limit of tolerance at which the machine is stopped has, normally, a value between 1 and 5% deviation. One of the two output rollers is mounted so that it can be moved out and serves as a scanning roller. The distance between the two draw-off rollers changes as a function of the volume of the fiber sliver. This distance is converted into an electrical signal by means of a position sensor and is transmitted to the monitor in the form of a measured magnitude. The monitor compares the measured magnitude with the 0% value set at the beginning. The machine is stopped if a deviation appears that is greater than the set limit value and longer than for a given delay period.

The goal in developing new drawing frames is to increase the output speed considerably. In this endeavor it has been found that a wider tolerance range of the fiber slivers must often be set with high production frames than with slow drawing frames in order to prevent automatic shut-off of the machine. It was, therefore, necessary to accept losses in quality as a consequence of the high output speed because a wider tolerance range had to be selected.

SUMMARY OF THE INVENTION

It is the object of the instant invention to increase the quality of the fiber sliver, in particular with high-speed drawing frames, by maintaining an extremely narrow admissible tolerance range of the fiber sliver thickness.

This object is attained, through the invention, in that at least one of the rollers of the pair of rollers is made a material with little heat expansion or a low coefficient of heat expansion. The material must be selected so that the heat expansion of the pair of rollers is lower during the operation than the set tolerance range of the fiber bundle thickness. It is, in that case, advantageous to ensure that the measurement can be effected with precision even with a lower admissible tolerance of fiber bundle thickness. The fiber bundle may be a fiber sliver, a roving or a thread. It is a special advantage of this invention that the desired value and appertaining tolerance range of the fiber bundle thickness to be measured can be adjusted before beginning of the measure and can be maintained throughout the entire time of the measurement, independently of the temperature of the rollers.

Ceramic material has proven to be especially advantageous in at least one of the pair of rollers. Silicon nitride has proven to be especially advantageous for this. Where measuring devices less exposed to temperature variations are used, or where wider tolerance ranges apply, the utilization of nickel alloys in the rollers has proven to be advantageous.

BRIEF DESCRIPTION OF THE DRAWINGS

The invention is described below through an embodiment.

Figure 1:
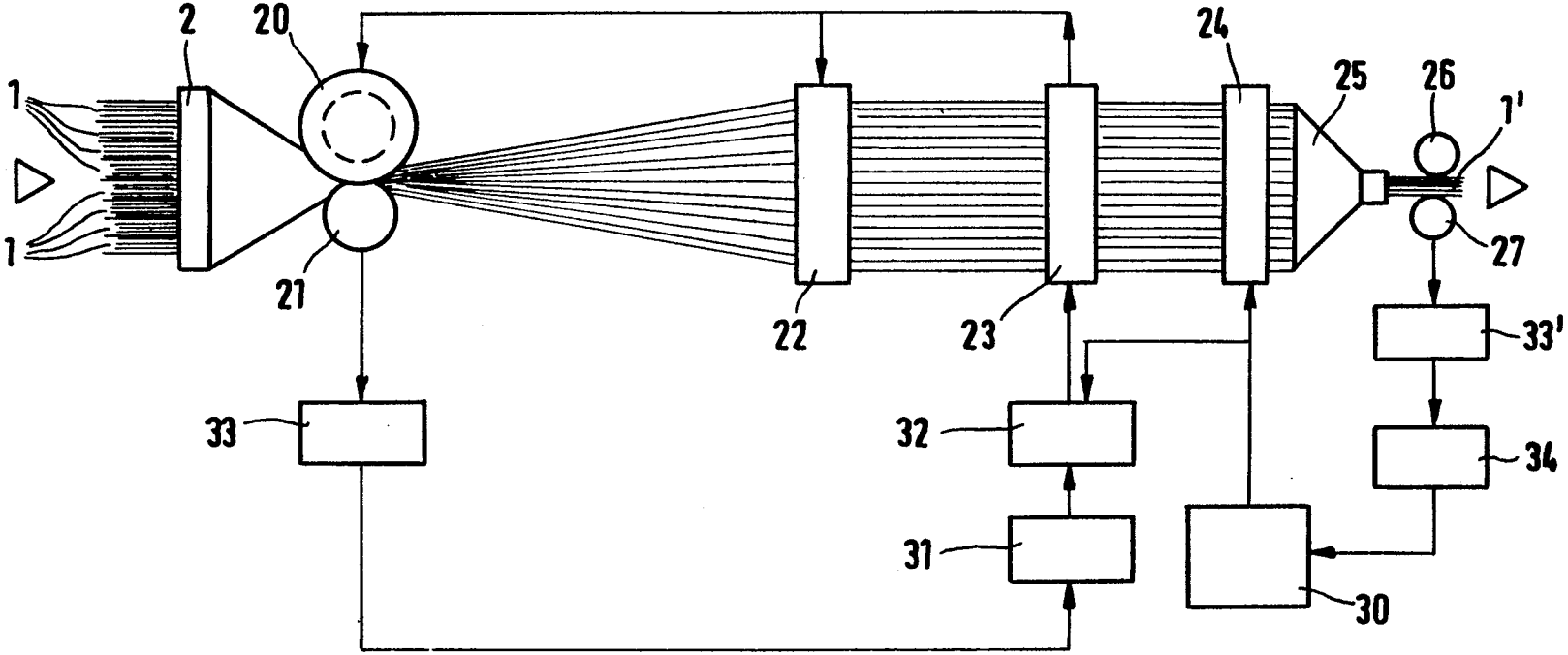
FIG. 1 is a schematic plan view representation of a autoleveller drawing frame.

A drawing frame in which several fiber slivers 1 are drawn is shown schematically in FIG. 1. The fiber slivers 1 are gathered together in a bundle in a sliver funnel 2 and are taken through a grooved roller 20 and a scanning roller 21. The fiber slivers 1 reach several drawing frame rollers in which they are drawn into a fiber sliver 1' of a predetermined thickness by the increasing speeds of the drawing frame rollers 22, 23, 24. Fiber sliver 1' is fed through a fiber guiding nozzle 25 to the delivery roller 24 and is thereby gathered together. The fiber sliver 1' is drawn off by a pair of draw-off rollers 26 and 27. The pair of draw-off rollers consists of a draw-off roller 26 and a scanning roller 27.

The fiber slivers 1 fed to the drawing frame lack uniformity. The adjusted fiber sliver 1', on the other hand possesses great uniformity, deviating only up to 1% from a desired value. In an autoleveller drawing frame the thickness of the supplied fiber slivers 1 is measured in the pair of rollers 20, 21. This is accomplished due to the fact that the grooved roller 20 is mounted on a stationary rotatable shaft (not shown). The scanning roller 21, on the other hand, is rotatably mounted on a shaft in such manner that the distance between the axle of the grooved roller 20 and the axle of the scanning roller 21 is able to change. Such a change results when a thicker or thinner fiber sliver 1 is guided through between the grooved roller 20 and the scanning roller 21. The grooved roller 20 and the scanning roller 21, which are pressed against each other by a spring, are separated from each other to varying degrees in this process. This varying distance can be detected by a contact-free distance sensor, for example, (not seen)and can be transformed into a measuring voltage that is an analog to the distance. This is effected in a signal converter 33. The measuring voltage thus found is transmitted via several units (not shown) for autolevelling of the drawing frame to an autoleveller motor 31. The autoleveller motor 31 acts upon a planetary gear 32 superimposed on the drive of a main motor 30 and upon the central roller 23. As a result the speed of the central roller 23 is increased or decreased, depending on whether a thick or a thin fiber sliver was detected between the groove roller 20 and the scanning roller 21. The speeds of the grooved roller 20 and of the drawing frame roller 22 are changed in relation to the speed of the central roller 23. The main motor 30 drives the drawing frame at a desired speed which is started after a desired delay set at the beginning of production. The linkage between the drive of the grooved roller 20, the drawing frame roller 22, the central roller 23 and the feed roller 24 is indicated by an arrow in FIG. 1.

The draw-off roller 26 and the scanning roller 27 effects a control to verify whether the autolevelled fiber sliver 1' lies within the predetermined tolerance range with respect to the fiber sliver thickness or, by analogy, to fiber sliver weight. The draw-off roller 26 and the scanning roller 27 are mounted similarly as with the grooved roller 20 and the scanning roller 21. While the draw-off roller is rotatably mounted in a stationary bearing on a shaft, the bearing of the scanning roller 27 is movable. Fluctuations of the thickness of the fiber sliver 1' causes the scanning roller 27 to be moved out to a greater or lesser degree. The conversion of the distance between the draw-off roller 26 and the scanning roller 27 into electrical values occurs in a signal converter 33'. Here, a contact-less displacement sensor, finds the distance between the rollers 26 and 27 and converts it into an electrical voltage analogous thereto. This voltage is detected and evaluated by a sliver monitor 34. If it exceeds a certain perceptual deviation from the desired value of the fiber sliver thickness over a previously set period of time, it transmits a signal to the main motor 30 to shut off the drawing frame. In this manner, the production of a fiber sliver which does not meet the required quality standards over a longer period of time is prevented. The stopping of the drawing frame enables the operator to look for the cause of the malfunction.

The distance between the rollers 20, 21, as well as the distance between the rollers 26, 27, is set before the beginning of the drawing process so that the signal converters 33 and 33' are given a desired value indication. The distance between the roller centers of the roller pair 20, 21 and also of the roller pair 27, 27 is, therefore, such that the control of the autolevelling device as well as of the sliver monitor 34, is able to interpret a change in distance between roller centers in the sense that an increase of the distance between roller centers represents greater fiber sliver thickness and a decrease of the distance between roller centers represents reduced fiber sliver thickness.

In particular with high-speed drawing frames, i.e. with drawing frames having a delivery speed of up to 1,000 meters/minute and over, the problem was encountered that the rollers 20, 21 and 26, 27 heat up considerably due to the high-speed passage of the fiber sliver over the rollers. It was then found that the heating up of the roller pairs was the main reason for the lack of precision of the drawn fiber sliver 1' to suffer greatly in high-speed draw frames. Furthermore, when the fiber sliver 1' was allowed a narrow tolerance range, the drawing frame was often shut off because the tolerance range was exceeded. By using the rollers 20, 21, and 26, 27 according to the instant invention, it is now possible to significantly reduce the heat-caused expansion of the rollers during the operation as compared with the rollers known from the state of the art. Due to the expansion of the rollers 20, 21 and 26, 27, there is nearly no difference between the distance between roller centers as set in the cold state (which represents the desired value) and the distance between the roller centers after they have run for a certain period of time.

Silicon nitride has proven to be an advantageous material for the rollers 20, 21 and/or 26, 27. This ceramic material has special advantages with respect to minimal expansion and great hardness and wear resistance. Where less precision in the autolevelled fiber sliver 1' or when delivery speeds are lower, nickel steel has proven to be an advantageous material for the rollers 20, 21 and/or 26, 27.

Figure 2:
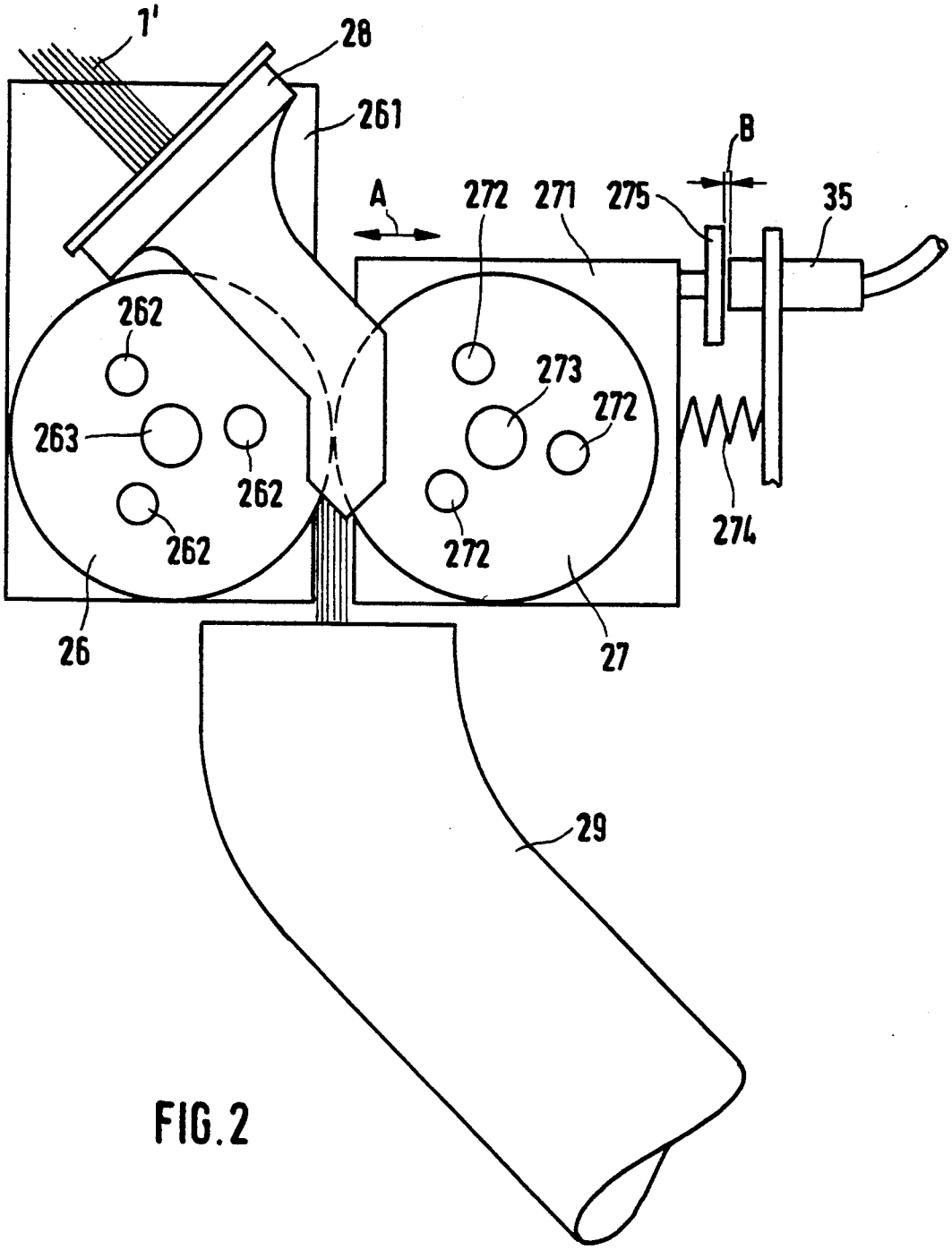
FIG. 2 is a schematic side view of a device for scanning the adjusted fiber sliver.

FIG. 2 shows the arrangement for measuring the autolevelled fiber sliver 1', taking the draw off roller 26 and the scanning roller 27 as an example.. The fiber sliver 1' is introduced into a beak funnel 28 and is fed to the draw-off roller 26 and to the scanning roller 27. The beak funnel 28 surrounds the draw-off roller 28 and the scanning roller 27 laterally, so that the fiber sliver 1' passes in its entirety between the two rollers. Once the fiber sliver 1 has passed the rollers it is introduced into a sliver channel 29 which proceeds to deposit the fiber sliver 1' into a can (not shown).

The draw-off roller 26 and the scanning roller 27 are attached on shafts by means of screws (not shown) going through bores 262 or 272. Centered bores 263 and 273 serve to center the draw-off roller 26 or the scanning roller 27 on their respective shafts. The draw-off roller 26 with its shaft is rotatably mounted in a bearing housing 261. The bearing housing 261 is mounted in a stationary position on the drawing frame. The scanning roller 227 is mounted rotatably on its shaft in the bearing housing 271. The position of the bearing housing 271 on the draw frame is such that it can be moved in direction A. The movement takes place against the force of a compression spring 274. The compression spring 274 presses the scanning roller 27 against the draw-off roller 26 and bears against a stationary component of the draw frame. To avoid damaging the rollers 26, 27 it may also be advantageous to keep the rollers 26, 27 at a distance of a few tenths of a millimeter from each other by means of a minimum-distance spacer between the bearing housings 261 and 271 when no fiber sliver 1' is present between the rollers 26, 27.

A measuring plate 275 is installed in the housing 271. This measuring plate 275 offers a precise reference surface for a displacement sensor 35. The displacement sensor 35 detects a distance B between the displacement sensor 35 and the measuring plate 275. The displacement sensor 35 transmits any change in the distance B to the sliver monitor 34 through a change in an electric voltage. The displacement sensor 35 thus serves as a signal converter 33 or 33' as shown in FIG. 1. The distance B, serving as displacement, is generally very small, i.e. a few tenths of a millimeter. Even the smallest changes in distance between the draw off roller and the scanning roller 27 are registered by the displacement sensor 35.

The utilization of ceramic rollers 26, 27 reduces significantly the temperature-dependency of the autolevelling or control device. The expansion of the rollers 20, 21 and/or 26, 27 is less under the effect of the temperature rise at high-speed operation of the drawing frame than the tolerance range to be determined of the drawn fiber sliver 1', and thereby a loss in quality is avoided.

The width of the rollers 20, 21 and/or 26, 27 is preferably kept low. This ensures that the fiber sliver is taken through between the roller pairs in a small width and thus provokes a relatively wide movement of the roller pairs. In this way, even small differences in the fiber sliver thickness can be ascertained. A width of approximately 5 mm has proven to be advantageous. The edges of the rollers 20, 21 and 26, 27 are advantageously sharp but without a burr. Fiber material can thus not be caught on the edges of the rollers 20, 21 and 26, 27 and cause erroneous measurements. Furthermore, the presence of the fiber sliver on the side, next to the rollers 20, 21, 26, 27, thus not contributing to the measurement, is thus avoided.

The invention is not limited to the embodiment shown.

I claim:

1. A measuring device for measuring the thickness of a fiber bundle within a predetermined tolerance range at high output speeds, comprising:

(a) a first rolled composed of a material having a low coefficient of heat expansion supported for rotation about a first axis;

(b) a second roller mounted for rotation about a second axis for cooperating with said first roller to measure the thickness of said fiber bundle;

(c) means for supporting at least one of said first and second axes for movement towards and away from the other of said axes to cause said rollers to contact said fiber bundle for measuring its thickness;

(d) means for pulling said fiber bundle between said first and second rollers causing said rollers to rotate and separate responsive to variation in thickness of said fiber bundle, and (d) means for detecting variations in the spacing of said first and second axes to measure variations in the thickness of said fiber bundle.

2. A measuring device as set forth in claim 1, wherein said first roller is composed of a ceramic material.

3. A measuring device as set forth in claim 2, wherein said ceramic material is silicon nitride.

4. A measuring device as set forth in claim 1, wherein said first roller is composed of a nickel alloy.

5. A measuring device as set forth in claim 1, wherein one of said rollers has a grooved circumference and the other of said rollers has a circumference adapted to fit within said grooved circumference.

6. A measuring device as set forth in claim 5, including spacer means for preventing the circumference surfaces of said rollers from coming into contact with one another.

* * * * *